US006749463B1

(12) United States Patent
Fan

(10) Patent No.: US 6,749,463 B1
(45) Date of Patent: Jun. 15, 2004

(54) SHIELDED BOARD MOUNTED ELECTRICAL CONNECTOR

(75) Inventor: Chia-Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/656,605

(22) Filed: Sep. 5, 2003

(30) Foreign Application Priority Data

May 28, 2003 (TW) ..... 92209838 U

(51) Int. Cl.[7] ..... H01R 13/648
(52) U.S. Cl. ..... 439/607
(58) Field of Search ..... 439/607, 108

(56) References Cited

U.S. PATENT DOCUMENTS 5,921,814 A 7/1999 Maruyama
6,080,016 A * 6/2000 Ho et al. ..... 439/607
6,086,421 A * 7/2000 Wu et al. ..... 439/607
6,322,394 B1 * 11/2001 Katoh et al. ..... 439/607

* cited by examiner

*Primary Examiner*—Lynn Feild
*Assistant Examiner*—Phuong Dinh
(74) *Attorney, Agent, or Firm*—Wei Te Chung

(57) ABSTRACT

A connector assembly includes a first connector (100) and a second connector (200). The first connector has a first dielectric housing (10) including a base (102) and a mating portion (16) extending from the base, a number of terminals (12, 13) received in the first housing, and a pair of shields (18, 19) juxtaposed against an outside surface of the mating portion with lower portions of the shields disposed in the base. The second connector has a second dielectric housing (20) including a second base (204) and a second mating portion (206) extending from the second base,a number of terminals (21, 22) received in the second housing, and a pair of shields (30,31). The second base and the second mating portion define a continuous slit (203) receiving the shields therein.

3 Claims, 5 Drawing Sheets

SHIELDED BOARD MOUNTED ELECTRICAL CONNECTOR

BACKGROUND OF THE INVENTION

1. Field of the Invention

This invention generally relates to the art of electrical connectors and, particularly to a shielded electrical connector for mounting on a printed circuit board.

2. Description of the Related Art

An electrical connector electrically connected to a printed circuit board is often equipped with a metal shield for shielding electrical contacts mounted therein. U.S. Pat. No. 5,921,814 (the '814 patent) discloses such kind of electrical connector assembly which generally includes a receptacle connector and a plug connector.

As is described in FIG. 1 to FIG. 3 of the '814 patent, the receptacle connector includes an elongated dielectric housing, two rows of terminals received in spaced arrays longitudinally of the dielectric housing and a one-piece conductive shield assembled on the housing. The housing includes a mating portion defined by a pair of long sidewalls which extend generally parallel to each other along a longitudinal direction of the housing and a pair of short end walls which extend generally parallel to each other along a lateral direction of the housing. The sidewalls and the end walls define an elongated plug-receiving slot therebetween. The metal shield has a plate portion juxtaposed against an inside surface of the long sidewalls and short end walls of the dielectric housing.

As is described in FIGS. 6–7, and 10 of the '814 patent, the plug connector includes an elongated dielectric housing, two rows of terminals received in spaced arrays longitudinally of the dielectric housing and a one-piece conductive shield assembled on the housing. The housing includes opposite end portions extending longitudinally outwardly from a central mating portion thereof. The mating portion of the plug connector comprises a pair of parallel long walls traversed by a pair of parallel short walls to define a generally hollow, elongated opening. The metallic shield has an elongated plate portion substantially surrounding the mating portion of the housing of the plug connector. When the plug connector is mated with the receptacle connector, the plate portion of the shield of the receptacle connector and of the plug connector together define a closed loop, which encloses the terminals inside, to provide Electro Magnetic Interference (EMI) protection.

However, each of the shields of the plug connector and of the receptacle connector is formed by drawing technology during the process of being stamped and molded. Using drawing technology, a designer must make more effort to design a die which is costly and the manufacture of the shield is still difficult.

Further, referring to FIG. 6 and FIG. 10 of the '814 patent, the plate portion of the shield assembled on the plug connector have a plurality of convex protrusions which provide a positive engagement with the plate portion of the metallic shield of the receptacle connector when the plug and receptacle connectors are mated. However, it is apparent that molding these protrusions during the process of drawing is hard and expensive, and the engagement effect enhanced by the protrusions is not worth its cost.

Hence, an improved shielded board mounted connector assembly is required to overcome the disadvantages of the prior art.

SUMMARY OF THE INVENTION

A major object of the present invention is to provide an improved shielded board mounted connector having a shield which is cost efficient and simply manufactured.

Another object of the present invention is to provide an improved shielded connector which mates with a complementary connector more reliably.

In order to achieve the objects set forth, a shielded electrical connector for mating with a complementary connector includes an elongated dielectric housing comprising a mating portion comprising a pair of sidewalls extending generally in a longitudinal direction thereof and a pair of end walls extending generally in a lateral direction thereof, a plurality of terminals received in the insulative housing and each including a contact portion, and a pair of shields assembled on the mating portion and forming a continuous loop.

Other objects, advantages and novel features of the invention will become more apparent from the following detailed description when taken in conjunction with the accompanying drawings.

DETAILED DESCRIPTION OF THE INVENTION

Figure 1:
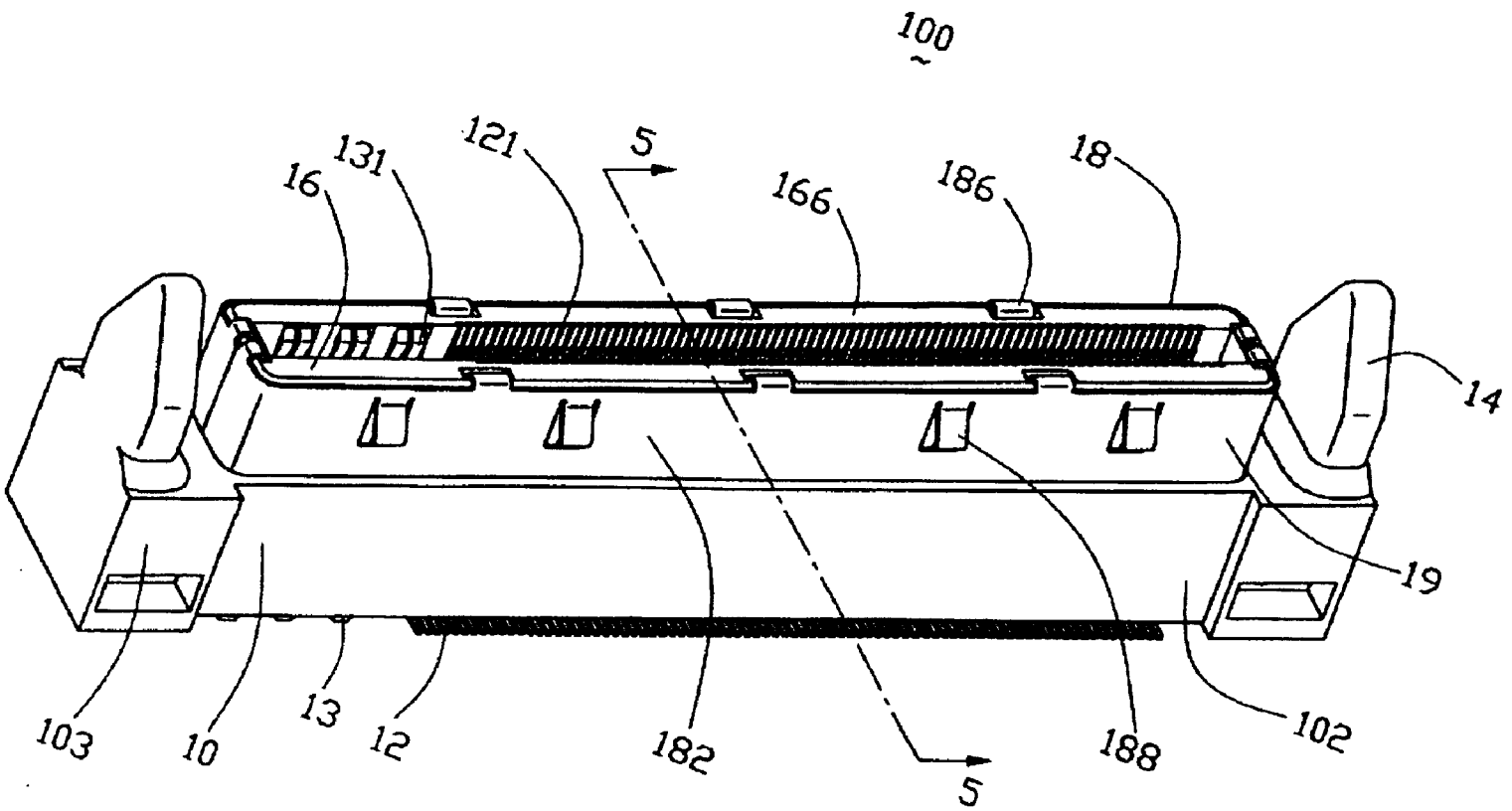
FIG. 1 is an assembled, perspective view of a plug connector of a connector assembly in accordance with the present invention.
Figure 3:
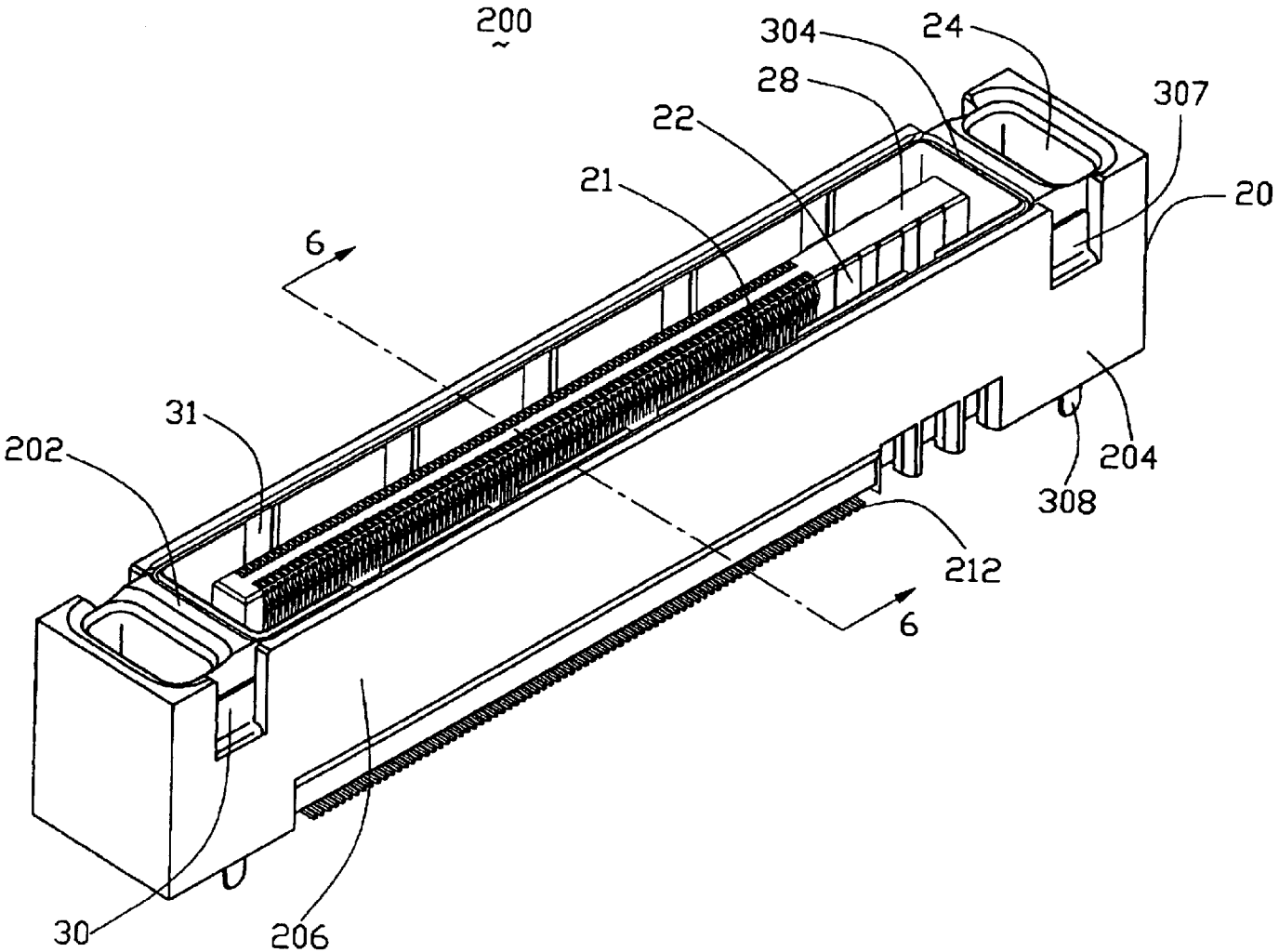
FIG. 3 is an assembled, perspective view of a receptacle connector of the connector assembly in accordance with the present invention.

Please refer to FIGS. 1 and 3, the feature of the invention are shown in a connector assembly which includes a receptacle connector 200 and a plug connector 100.

Figure 2:
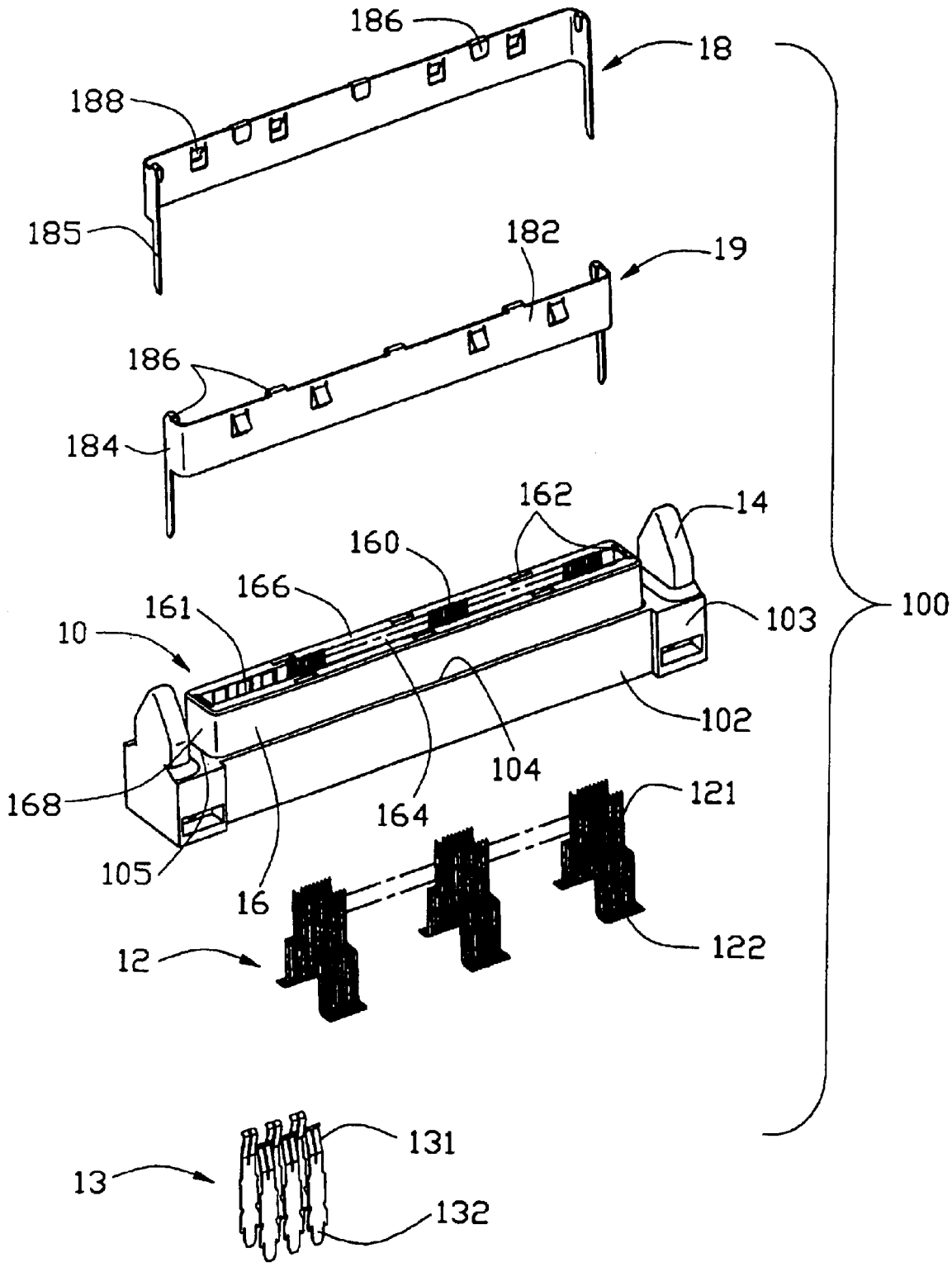
FIG. 2 is an exploded, perspective view of the plug connector of FIG. 1.

Please refer to FIGS. 1 and 2, the plug connector 100 for mounting to a surface of a printed circuit board (not shown) comprises an insulative housing 10, a plurality of terminals 12, 13 received in the housing 10 and a pair of shields 18, 19 assembled on the housing 10.

The housing 10 is elongated and includes a base 102 and a mating portion 16 extending upwardly from the base 102. Opposite end portions 103 extend longitudinally outwardly from the base 102 with a pair of locating posts 14 projecting upwardly respectively therefrom for purpose described hereinafter. The mating portion 16 of the plug connector 100 comprises a pair of parallel long sidewalls 166 traversed by a pair of parallel short end walls 168 to define a generally hollow, elongated opening 164 therebetween. A plurality of terminal channels 160, 161 is formed on an inside surface of the sidewalls 166. A plurality of spaced notches 162 extend downwardly from top surfaces of the sidewalls 166 and the end walls 168. A plurality of slots 104, 105 is respectively formed adjacent to lower portions of the sidewalls 166 and the end walls 168.

The terminals 12, 13 include a plurality of signal terminals 12 and a plurality of power terminals 13. Each terminal 12, 13 includes a contact portion 121, 131 for engaging with a contact of a receptacle connector and an opposite tail portion 122, 132 for mounting to the printed circuit board.

The pair of metallic shields 18, 19 have the same structure as each other, and each of the shields 18, 19 has a flat body 182. A pair of opposite wings 184 extends laterally from opposite end of the body 182. A grounding tail 185 extends downwardly from a corresponding longitudinal end of each wing 184 for connecting the metallic shields 18, 19 of the plug connector 100 to appropriate ground circuit traces on the printed circuit board. A plurality of spaced latches 186 extend inwardly and downwardly from a top of the body 182 and the wings 184. A plurality of spaced spring tabs 188 extends outwardly from the body 182.

Figure 5:
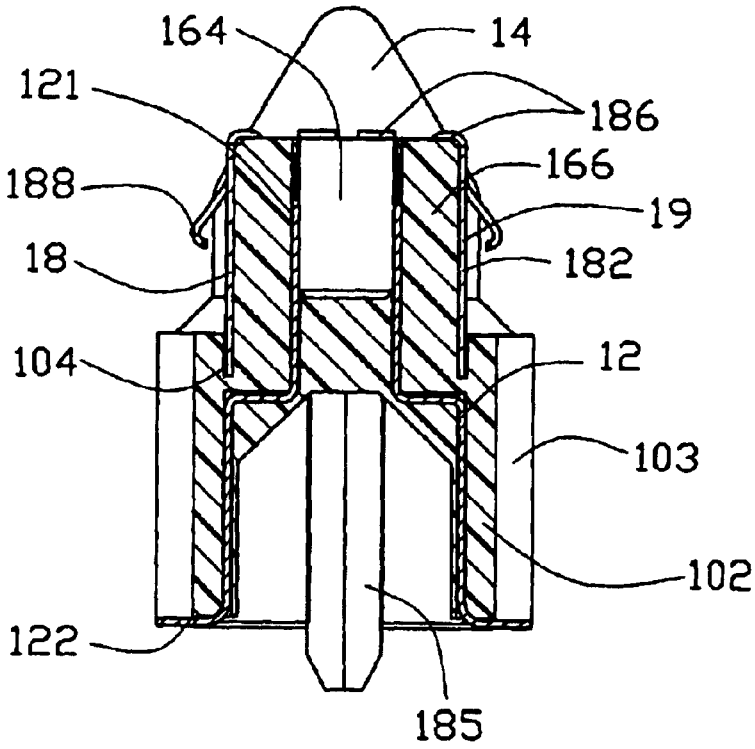
FIG. 5 is a cross-sectional view of the plug connector taken along line 5—5 of FIG. 1.

In assembly, the terminals 12, 13 are inserted into the housing 10 in a down-to-up direction. The signal terminals 12 and the power terminals 13 are respectively received in the corresponding terminal channels 160, 161 with the tail portion 122, 132 thereof extending beyond a lower portion of the housing 10. The pair of shields 18, 19 are assembled onto the housing 10 in an up-to-down direction. The flat body 182 of each shield 18, 19 is attached to the outside surface of the sidewall 166 with a lower portion thereof being received in the slot 104 (FIG. 5) of the sidewall 166. The wings 184 are attached on the outside surface of the end walls 168 with a lower portion thereof being received in the slots 105 of the end walls 168. The grounding tail 185 extends downwardly through an access (not shown) defined in the base 102 beyond the housing 10. The latches 186 engage with the notches 162 of the housing 10, respectively.

The wings 184 of the two shields 18, 19 join to each other to form a closed loop enclosing the outside of the mating portion 16 with the opening 164 uncovered. Therefore, the shields 18, 19 can provide good anti-EMI protection to the contact portions 121, 131 of the terminals 12, 13 located therebetween.

Figure 4:
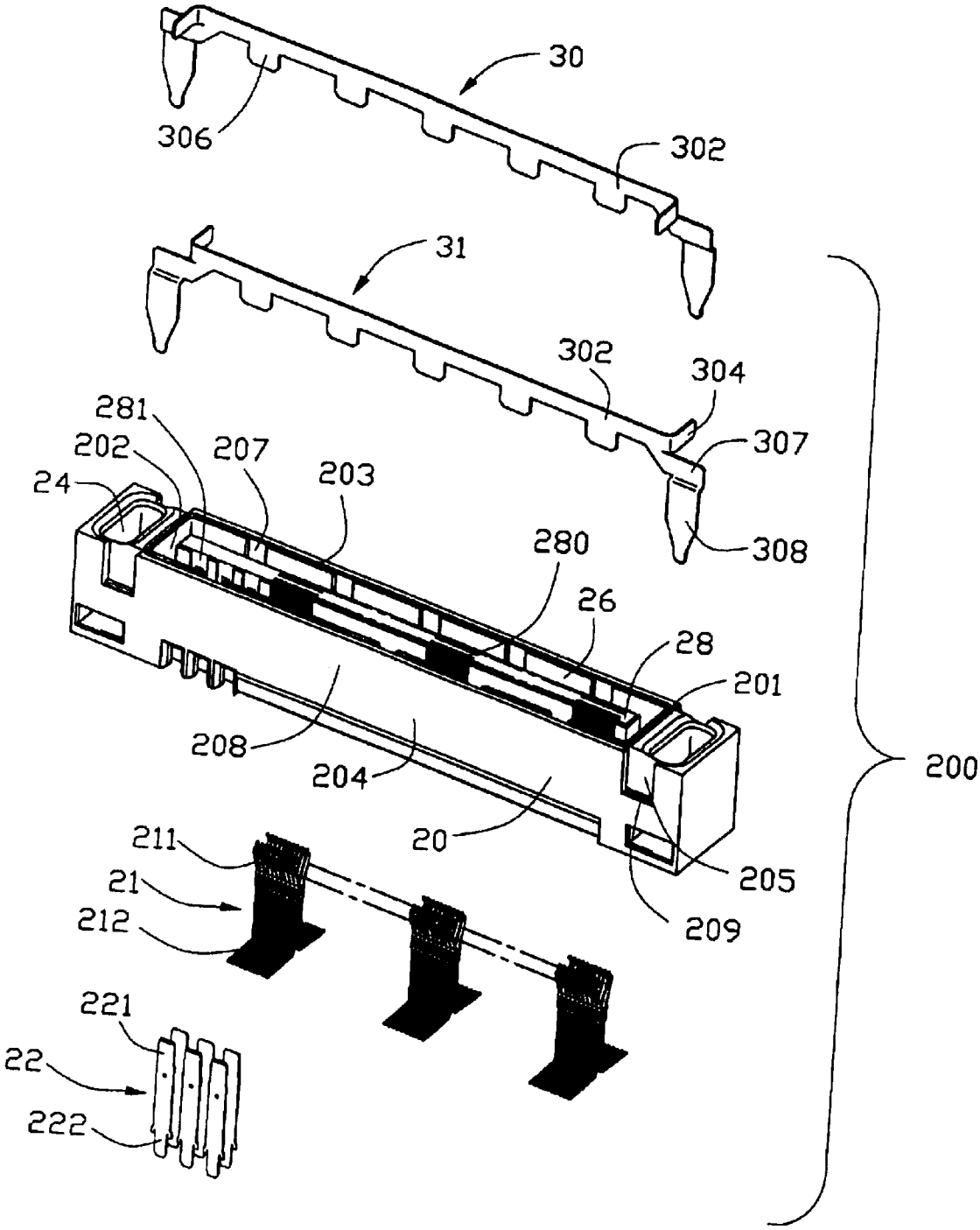
FIG. 4 is an exploded, perspective view of the receptacle connector of FIG. 3.
Figure 6:
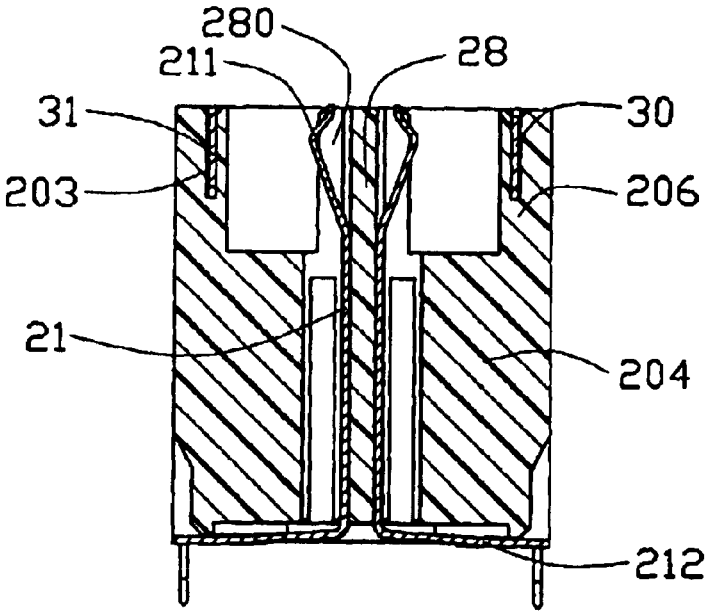
FIG. 6 is a cross-sectional view of the receptacle connector taken along line 6—6 of FIG. 3.

Please refer to FIGS. 3–4 and 6, the receptacle connector 200 comprises an insulative housing 20, a plurality of terminals 21, 22 received in the housing 20 and a pair of shields 30, 31 assembled to the housing 20.

The housing 20 is elongated and includes a base 204 and a mating portion 206 extending upwardly from the base 204. The mating portion 206 comprises a pair of long sidewalls 208 which extends generally parallel to each other along a longitudinal direction of the housing 20 and a pair of short end walls 206 which extend generally parallel to each other along a lateral direction of the housing 20. The sidewalls 208 and the end walls 202 define an elongated plug-receiving receptacle 26 therebetween.

The mating portion 206 also includes a tongue 28 extending upwardly from the base 204 and located in a center of the receptacle 26, and a plurality of terminal channels 280, 281 formed on opposite surfaces of the tongue 28. The sidewalls 208 and the end walls 202 together define a continuous slit 203 downwardly from a top thereof. The sidewalls 208 define a plurality of grooves 207 in an inside surface thereof communicating with the slit 203 at the top of the sidewalls 208.

A pair of spaced trenches 205 extends downwardly from the top of opposite outside surfaces of the sidewalls 208, respectively. Each trench 205 communicates with the slit 203 in the sidewalls 208 longitudinally. A split 209 extends downwardly through the housing 20 from a lower end of each trench 205. A receiving room 24 is formed in each longitudinal end of the housing 20 for receiving a corresponding post 14 of the plug connector 100.

The terminals 21, 22 include a plurality of signal terminals 21 and a plurality of power terminals 22. Each terminal 21, 22 includes a contact portion 211, 221 for engaging with contacts of a complementary connector and an opposite tail portion 212, 222 for mounting to a printed circuit board.

The pair of metallic shields 30, 31 have the same structure as each other, and each of the shields 30, 31 has a flat body 302 and a plurality of spaced engage portions 306 extending downwardly from a lower portion of the body 302.

A pair of opposite wings 304 extends laterally from the body 182. A pair of spaced connect portions 307 extends longitudinally outwardly from the body 302. A grounding tail 308 extends downwardly from a lower portion of the connecting portion 307, and the tail 308 extends downwardly beyond the housing 20 for connecting the metallic shields 30, 31 of the receptacle connector 100 to appropriate ground circuit traces on the printed circuit board.

In assembly, the terminals 21, 22 are inserted into the housing 20 in a down-to-up direction. The signal terminals 21 and power terminals 22 are respectively received in the terminal channels 280, 281 with the tail portions 212, 222 thereof extending beyond a lower portion of the housing 20. The pair of shields 30, 31 are assembled to the housing 20 in an up-to-down direction. The body 302 with the engage portions 306 of each shield 30, 31 is respectively received in the continuous slit 203 of the sidewall 208, and each engage portion 306 is received in a corresponding groove 207. The wings 304 are received in the slit 203 of the end wall 202. The connect portions 307 are respectively received in the trenches 205 with each tail 308 being received in a corresponding split 209.

The wings 304 of the shields 30, 31 join to each other to form a closed loop enclosing the plug-receiving receptacle 26 with the opening uncovered. Therefore, the shields 30, 31 can provide good anti-EMI protection to the contact portion 211, 221 of the terminals 21, 22 located therebetween.

When the plug connector 100 mates with the receptacle connector 200, the mating portion 16 of the plug connector 100 is received in the plug-receiving receptacle 26 of the receptacle connector 200, and the tongue 28 of the receptacle connector 200 is received in the opening 164 of the plug connector 100. The contact portions 121, 131 of the terminals 12, 13 of the plug connector 100 respectively engage with the contact portions 211, 221 of the terminals 21, 22 of the receptacle connector 200. The locating posts 14 of the plug connector 100 are respectively received in the receiving rooms 24 of the receptacle connector 200. The spring tabs 188 of the plug connector 100 abut against the engage portions 306 of the receptacle connector 200 to form an electrical connection between the shields 18, 19 of the plug connector 100 and the shields 30, 31 of the receptacle connector 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. An electrical connector, comprising:

an elongated dielectric housing comprising a base and a mating portion, the mating portion comprising a pair of sidewalls extending generally in a longitudinal direction thereof and a pair of end walls extending generally in a lateral direction thereof;

a plurality of terminals received in the dielectric housing; and a pair of shields enclosing the mating portion, each of the shields comprising a flat body attached to one of the sidewalls and a wing attached to one of the end walls; wherein the housings comprises a plurality of space notches in the sidewalls and the end walls, and wherein each of shields comprises a plurality of spaced latches extending inwardly and downwardly from the flat body thereof and the wings and engaging with the notches of the sidewalls and the end walls; wherein the base defines a plurality of slots and wherein the flat body and the wings comprise bottom edges received in the slots, respectively; wherein the wing comprises a grounding tail extending downwardly through the base and beyond the housing; wherein the pair of end walls and the pair of sidewalls together define a continuous slit extending downwardly from a top thereof and wherein the flat body and the wings are received in the slit of the sidewall and end wall; wherein the housing defines a pair of spaced trenches on outside surfaces of the sidewalls, respectively, and communicating with the slit of the sidewall and wherein each of the shields comprises a pair of connect portions received in the trenches; wherein the sidewalls define a plurality of hooves of inside surface thereof and communicating with the slit of the sidewalls and wherein each of the shields comprises a plurality of engage portions exposed in the groove of the sidewall; wherein the housing comprises a split extending downwardly through the base and communicating with the trench, and wherein each of the shields comprises a grounding tail received in the split.

2. The electrical connector of claim 1, wherein the wings of the shields join to each other to form a closed loop between the shields.

3. The electrical connector of claim 1, wherein each of the shields comprises a plurality of spring tabs extending outwardly from the flat body.

* * * * *